US008568115B2

(12) United States Patent
Lauer

(10) Patent No.: US 8,568,115 B2
(45) Date of Patent: Oct. 29, 2013

(54) PERISTALTIC HOSE PUMP

(75) Inventor: Martin Lauer, St. Wendel (DE)

(73) Assignee: Fresenius Medical Care Deutschland G.m.b.H., Bad Homburg (DE)

( * ) Notice: Subject to any disclaimer, the term of this patent is extended or adjusted under 35 U.S.C. 154(b) by 279 days.

(21) Appl. No.: 12/451,244

(22) PCT Filed: May 2, 2008

(86) PCT No.: PCT/EP2008/003564

§ 371 (c)(1),
(2), (4) Date: Nov. 2, 2009

(87) PCT Pub. No.: WO2008/135245

PCT Pub. Date: Nov. 13, 2008

(65) Prior Publication Data

US 2010/0129247 A1 May 27, 2010

(30) Foreign Application Priority Data

May 2, 2007 (DE) ..... 10 2007 020 573

(51) Int. Cl.
*F04B 43/12* (2006.01)

(52) U.S. Cl.
USPC ..... 417/477.8

(58) Field of Classification Search
USPC ..... 417/477.3, 477.7, 214, 477.8
See application file for complete search history.

(56) References Cited

U.S. PATENT DOCUMENTS

| | | | | |
|---|---|---|---|---|
| 4,070,725 | A * | 1/1978 | Austin et al. | 417/236 |
| 4,142,845 | A * | 3/1979 | Lepp et al. | 417/477.8 |
| 4,184,815 | A * | 1/1980 | Casson et al. | 417/477.7 |
| 4,205,948 | A | 6/1980 | Jones | |
| 4,441,867 | A | 4/1984 | Berelson | |
| 4,568,255 | A | 2/1986 | Lavender et al. | |
| 4,781,548 | A * | 11/1988 | Alderson et al. | 417/474 |
| 4,846,787 | A * | 7/1989 | Aall-Flood et al. | 604/6.09 |
| 5,549,458 | A | 8/1996 | Chapman et al. | |
| 6,641,249 | B2 | 11/2003 | Miyauchi | |
| 6,733,255 | B2 * | 5/2004 | Ota et al. | 417/477.7 |
| 7,018,011 | B2 | 3/2006 | Youn | |

FOREIGN PATENT DOCUMENTS

| | | |
|---|---|---|
| DE | 1 807 979 A1 | 7/1969 |
| DE | 43 23 851 A1 | 1/1995 |
| DE | 42 45 001 C2 | 10/2001 |
| DE | 601 00 417 T2 | 4/2004 |
| WO | WO 91/16542 | 10/1991 |
| WO | WO 95/17598 | 6/1995 |

* cited by examiner

*Primary Examiner* — Devon Kramer
*Assistant Examiner* — Thomas Fink
(74) *Attorney, Agent, or Firm* — Jacobson Holman PLLC

(57) ABSTRACT

A hose roller pump includes a stator, a rotor, and a rotor drive. The rotor includes hose rollers whose position is variable in the radial direction via an adjustment apparatus having an adjustment element. The pump includes a brake device, and the radial position of the hose rollers is variable by the interplay of the brake device and the rotor drive.

32 Claims, 9 Drawing Sheets

PERISTALTIC HOSE PUMP

CROSS REFERENCE TO RELATED APPLICATION

This is a national stage of PCT/EP08/003564 filed May 2, 2008 and published in German, which has a priority of German no. 10 2007 020 573.4 filed May 2, 2007, hereby incorporated by reference.

BACKGROUND OF THE INVENTION

1. Field of Invention

The present invention relates to a hose roller pump comprising a stator, a rotor and a rotor drive, with the rotor including hose rollers.

2. Description of the Prior Art

In such hose roller pumps, a hose is inserted between the rotor and the hose roller path of the stator and is pressed by the hose rollers in each case against the hose roller path so that liquid is pumped through the hose by the rotation of the rotor and thus the revolving movement of the hose rollers. Such hose roller pumps find a plurality of uses in particular in medical engineering and are used especially in dialysis, in particular in hemodialysis or peritoneal dialysis, for the pumping of medical liquids such as dialysis liquid or blood.

A simple base type still dominates among the hose roller pumps for disposable pump hoses established on the market for medical engineering. This long known base form of a hose roller pump on which the hose roller pump of the present invention is also based will now be explained in more detail. The reference numerals correspond in this connection to the reference numerals also used in FIGS. 1 to 8 which show the hose roller pump of the present invention, with reference likewise being made to these Figures for the explanation of basic functions which are used in the hose roller pump of the present invention and equally in the prior art.

In this connection, the rotor comprises the rotationally driven hub shell 4 at which, as a rule, two rotating wings 5 are supported radially outwardly assisted by a spring, with a respective hose roller 9 being fastened to each of the outer ends of said wings which attempts to squeeze the hose 2 peripherally against the hose roller track. The hose roller track is a component of the fixed-position part of the hose roller pump which is often called a pump bed or stator 1. FIG. 1 explains the functional division of the hose roller running track into three different segments. The middle segment 17 (occlusion region) covers approximately 180 degrees and represents a cylindrical surface. The hose is completely occluded by the hose rollers in this segment. The segments 18 (transition regions) adjoining in the manner of a mirror image extend over approximately 20 . . . 30 degrees. In this region, the radius of the roller running track increases continuously without the pump hose moving out of occlusion. The wings rather still follow the increase in radius until the point is reached toward the end of the transition region at which the wings run onto abutments which are arranged between the hub shell and the wing and bound the further radial outward movement of the wings and hose rollers. Such abutments are provided at each hose roller pump and are not shown in the Figures. In the last segment 19 (opening region) which adjoins at both sides in the manner of a mirror image, the radius of the roller running track increases further while the wing remains at the said abutment until the pump hose has moved completely out of engagement by the hose rollers still before the start of the pump bed mouth region 20. In this mouth region, the pump hose moves into the pump bed and leaves it again. The aforesaid wing abutments have the additional object of preventing the hose rolls from striking the hose roller track when the pump hose has been removed. For this purpose, the abutments are set so that they permit a residual gap of approximately 1 mm between the hose roller and the roller running track, much less than twice the wall thickness of the occluded pump hose (occlusion condition).

To avoid the unwanted departure of the pump hose from the pump bed, the pumps usual on the market have a plurality of hose guiding wings 21 which project radially outwardly from the hub shell like individual prongs and end in front of the hose roller running track at a low end face distance of approximately 1 to 3 mm. The hose guiding wings are usually equipped with rotatable rollers to avoid friction and wear and play an important role on the threading in and out of the pump hose. If the rotor is brought into a rotary position in which a hose guide wing faces in the direction of the opening of the pump mouth the free spaces at both sides of the adjacent positions of the pump bed mouth are thus sufficient for the operator to be able to introduce the half of the pump hose at the inflow side so far in the direction of the pump bed base that the hose guide wing combs over the hose in the following thread-in rotary movement of the rotor and sweeps it into the pump bed. Since the hose rollers are moved out up to the abutments with customary hose pumps, the hose guide wings have to exert so much force on the hoses as necessary to urge them into the gap between the hose roller and the roller running track, said gap initially being approx. 1 mm wide, and to bring the wings to pivot in against the force of the springs until the pump hose is completely threaded in and is rolled over by the two hose rollers. The elastomeric pump hose is deformed by this exertion of force and attempts to penetrate into the gap between the hose roller track and the end face of the hose guide wings. To preclude this reliably, the spacing between the end face of the hose guide wings and the hose roller track may only lie between approximately 2 . . . 3 mm in the conventional hose pumps. Equally, the rounding radius of the guide roll toward the end face may not be much larger than 1 mm because a sufficient condition for the clamping of the pump hose on the thread-in procedure would also then arise. Occasionally, the pump hose is still clamped on the threading in, which as a rule results in damage to the hose and requires the replacement of the pump hose. The diagonal urging of the pump hose into the desired position can also occasionally be associated with damage to the pump hose which is usually due to the local overstrain on the passing of the end edges of the hose rollers. A further failure can occur when the pump hose is not introduced sufficiently deeply by the operator so that the end face of the hose guide wing disposed most closely can receive the hose on the approach to the hose roller track and can damage it. On such an incident, the ball bearing of the rotor shaft on the output side can also be overstrained, which can result in pump failure days or months later. A third and much more critical possible failure consists of the operator not removing his finger from the pump bed in time and there thereby being the danger of injury due to the collision with the hose guide wing or with the hose rollers.

A similar procedure takes place on the same side of the pump bed mouth on the thread out of the pump hose: with a stationary pump in an angular position as before, the end of the pump hose at the inflow side must be raised so far out of the pump bed that, after the switching back of the rotor movement, those guide wing disposed most closely combs under the pump hose and peels it out of the pump bed in a similar fashion to a tire lever movement. Corresponding failures as during the threading in can also occur here.

Due to the disadvantages described above of the manually equipped hose pumps, a semi-automatic mechanism was introduced with dialysis machines which works as follows: the pump hose is held at both sides in a component called a clip which is introduced into the pump mouth region in a latching manner by the person on the insertion. The pump hose thereby comes into the position which is required for the subsequent threading in and a position report contact is triggered. In this manner, the operator can remove the hands and actuate the starting button for the following automatic threading in. The threading out of the pump hose segment takes place automatically in that the rotor stops in the thread-out start position and a lifting actuator raises the clip with a tilt movement so far out of the pump mouth region as is required for the following automatic threading out.

The mechanism just described still has the disadvantage that the pump housing is exposed to strong mechanical strains on the threading in and out and that small errors in the coordination of the geometrical and force-related ratios between the machine and the pump hose segment can result in problems. The mechanism cannot be used in some applications since it necessarily requires a tiling of the pump hose segment at the start of the thread-out phase which cannot be carried out, for example, with cassette systems having a plurality of hose pump segments. A further disadvantage of the mechanism just described consists in the increased space requirements and in the increased manufacturing costs since an additional electrically or pneumatically driven linear unit for the lifting of the pump hose segment out of the pump bed is added to the original rotor mechanism.

It has therefore partly been attempted for the facilitating of the hose change to split the pump hose bed into a plurality of parts and to move them radially outwardly to be able to insert or remove the hose better. In this connection, the problem arises, however, that the joints of the segmented hose roller track are rolled over continuously during pumping so that problems in the pump function (such as e.g. an additional pulsation or a leak) can occur and an increased wear of the pump hose has the consequence of a lower reliability in pump operation. In addition, such a solution has a considerably increased constructional space requirement and has a number of additional parts and joints, which are not rotarily movable and which increase the technical effort, impair the appearance (joint appearance), result in abrasion marks at the guides and risks of functional failure (dirt and increasing friction impair the function), make the sealing of the machine space more difficult and result in the risks of clamping. In addition, a pump bed which can be opened as widely as desired cannot prevent the pump hose segment from still being radially outwardly widened in embodiments as a pre-fixed loop due to the rollers moved out up to the abutment and thus from being spreadingly fixed, which only enables the complete installation when using the hands and prevents the dismantling by shape matching and force transmission. The problems with the hose guide wings additionally still result, which bring about the problem scheme already described above.

For this reason, an adjustable pump bed is generally dispensed with and instead the rotor is configured to be adjustable. In this context, an adjustment device is usually provided with an adjustment element by which the position of the hose rollers is adjustable in the radial direction. The hose rollers can thus be pulled through the adjustment device for the secure laying of the hose between the rotor and the hose roller track. The pump hose is hereby geometrically set completely free on installation and dismantling. The problems of a segmented pump roller track are also dispensed with.

In this connection, it is known from U.S. Pat. Nos. 4,568,255 and 5,549,458 to adjust the rollers manually in the radial direction via a rotary knob. Such a manual adjustment possibility is, however, less user friendly and moreover extremely prone to operating errors. In addition, the known manual adjustment possibilities are very complex and/or expensive in construction.

An adjustability of the rollers via a separate adjustment drive is, in contrast, known from WO 95/17598 A1 as well as from U.S. Pat. No. 4,205,948, with here, however, a complicated joint arrangement as well as the complicated adjustment drive arranged outside the rotor being necessary.

SUMMARY OF THE INVENTION

It is therefore the object of the invention to make available a hose roller pump having an adjustment device for the hose rollers in which a complete exposure of the pump hose segment for the situation of the installation and dismantling of the pump hose provides much improved ergonomics and security on the changing of the pump hose, with only a minimal additional cost effort being achieved, however, in comparison with hose pumps without an adjustment option and with additionally an unchanged reliable pump function being ensured in comparison with the proven prior art. In addition, only as little an additional requirement of construction space as well as of components of the mechanism, electronics and software as possible should be necessary. In addition, no impairment should also result in the fields of design and cleaning behavior.

This object is solved in accordance with the invention by a hose roller pump as described herein. Such a hose roller pump comprising a stator, a rotor and a rotor drive, with the rotor including hose rollers whose position is adjustable in a radial direction via an adjustment device with an adjustment element, now has, in accordance with the invention, a brake device, with the radial position of the hose rollers being variable by the interplay of the brake device and the rotor drive.

A substantially simpler and more reliable operation of the hose roller pump in accordance with the invention hereby results in comparison with manual adjustment possibilities without a separate adjustment drive and a complicated mechanism being required for this purpose. In accordance with the invention, the rotor drive anyway present can be used as the drive of the roller retraction mechanism, which guarantees a cost-saving implementation of the present invention. No different function also results with respect to conventional hose pumps in pump operation so that the proven high reliability in pump operation is also guaranteed in the present invention. In this context, substantially only the adjustment element and the brake device are required as additional elements so that a mechanism of largely the same construction space is made possible with only a few additional components and so lower costs.

It is nevertheless possible with the present invention, by a complete geometrical release of the pump hose segment after the retraction of the rollers, to ensure a simple laying in and removal of the simple pump hose, of a pre-fixed pump hose (clip) or of a cassette fitted with a pump hose. Thanks to the chosen principle, the hose roller pump in accordance with the invention is in particular also suitable for use with cassettes in which a rigid cassette body is inserted e.g. into a dialysis machine and the pumping of the liquid (such as blood) flowing through the cassette should be carried out by a roller pump. In this case, the hose to be laid in the roller pump is usually configured as a loop projecting from the cassette.

Furthermore, the hose roller pump in accordance with the invention is also suitable for those cassettes which are equipped with more than one pump hose.

Further advantageously, the braking effect of the brake device can be triggered in the hose roller pump in accordance with the invention by actuation of a brake actuator. The adjustment movement can thus be initiated by a direction actuation of the brake device. The adjustment of the hose rollers thus takes place comfortably via actuation of the brake device and the rotor drive.

For this purpose, the brake actuator is advantageously controlled by the control of the pump. An automatically running process for the coupling and uncoupling of the hose rollers at the pump hose segment is in particular hereby possible so that the possibility results of a pump bed covering while avoiding injury risks for the operator.

Further advantageously in this connection, the brake device inhibits the movement of the adjustment element so that the adjustment element can be moved with respect to the rotor by braking the adjustment element and by rotating the rotor in order to vary the position of the rollers. A particularly simple mechanism hereby results in which the existing rotor can be taken over substantially unchanged and only an adjustment element correspondingly cooperating with the braking device has to be provided.

Advantageously, in this connection, the adjustment element is rotatably supported coaxially to the rotor. A particularly simple movement geometry for the adjustment element hereby results, with the latter only having to be braked for the moving out or in of the rollers, while the rotor is rotated coaxially to the adjustment element. A mechanism hereby results which is extremely simple and space-saving in construction. In addition, such a rotatable support of the adjustment element has substantial advantages with respect to the design and the cleaning capability. Further advantageously, the adjustment element in this connection forms an adjustment plate which is rotatably supported coaxially to the rotor.

Further advantageously, the adjustment element in accordance with the invention is rotatably supported at the rotor. The rotor and the adjustment elements thus advantageously form a single assembly, which in turn permits a simple and space-saving construction. A better cleaning capability of the device and a better design also results here due to the rotatable support. An already known rotor can substantially be made use of in this connection, with only the adjustment element having to be rotatably supported thereon.

Advantageously, the adjustment element rotates along with the rotor in normal operation in the hose pump in accordance with the invention. The support of the adjustment element advantageously takes place directly and without ball bearings so that a bearing friction between the adjustment element and the support at the rotor deliberately generated by the construction provides a knock-free pump operation. The adjustment element is then only braked with respect to the rotor for the radial adjustment of the hose rollers and is thus moved, in particular rotated, with respect to the rotor.

Further advantageously, the adjustment element in accordance with the invention is made symmetrical and/or latchable to the rotor, in particular in a position in which the hose rollers are moved out. It can be prevented by a symmetrical construction of the adjustment element that vibrations, e.g. between the stator and the rotor, result in unwanted rotations between the adjustment element and the rotor or to an unwanted knocking of the adjustment element, since a symmetrically configured adjustment element cannot experience any positionally dependent different frictional force transfer at the rotary bearing position. An unwanted rotation between the adjustment element and the rotor can also be reliably prevented by a latching capability of the adjustment element with the rotor, e.g. in the position in which the hose rollers are moved out and in which the adjustment element is located in the normal operation of the rotor. It is equally conceivable to insert an element to increase friction between the adjustment element and the rotary axle.

Further advantageously, the brake device in the hose roller pump in accordance with the invention hinders the relative movement between the stator and the adjustment element. The adjustment element is thus hindered in its movement with respect to the stator by the brake device, whereas the rotor is further rotated via the drive shaft with respect to the stator and thus a relative movement is generated between the rotor and the adjustment element. A particularly simple and nevertheless reliable adjustment possibility results by such a mechanism.

Further advantageously, the rotor of the hose roller pump in accordance with the invention includes moving bearing elements at which the hose rollers are rotatably supported. These bearing elements can press the hose rollers outwardly against the hose, e.g. under spring strain. The wings already known from the prior art and pivotably hinged to the rotor via wing hinges can here e.g. be used as bearing elements.

Further advantageously, in accordance with the invention, the adjustment element and/or the rotor have a guide which cooperates with one or more counter-elements for the radial movement of the hose rollers. Due to the relative movement of the adjustment element and the rotor, the counter-elements move along the guide and generate a radial movement of the hose rollers. A mechanism is hereby possible which is as simple as it is space-saving and which manages with a minimal increased cost effort in comparison with known hose pumps. The specific form of the guide can be matched ideally to the required adjustment geometry.

In a particularly preferred embodiment, the guide is arranged at the adjustment element, whereas the counter-elements are arranged at the rotor. A constructionally especially simple situation hereby results since the already existing rotor only has to be equipped with the counter-elements and the guidance is taken over by the adjustment element which has anyway to be made new.

Further advantageously, the counter-elements and/or the guidance are fixedly connected to the bearing elements for the hose rollers. The bearing elements of the hose rollers are thus directly moved by the interaction of the counter-elements and the guidance when the adjustment element is moved, advantageously rotated, with respect to the rotor. In a particularly advantageous embodiment, the counter-elements are directly arranged at the bearing elements for the hose rollers, with them furthermore advantageously being directly arranged at the projecting axial sections of the hose rollers. The counter-elements can furthermore advantageously comprise guide rollers.

Further advantageously, the guidance in accordance with the invention forms a cam groove. The counter-elements can engage into such a cam groove and are moved radially by the cam groove on a movement of the adjustment element with respect to the rotor.

Further advantageously, the guidance forms a peripheral ring guide in accordance with the invention. An effective overload protection hereby arises on problems of the control processes of the rotational angle of the rotor with an applied brake. A crash is in particular effectively prevented by abutment of a counter-element against the ends of the guidance, with the gradient of the guidance advantageously being selected to be so large that the rotor mechanism can also not be overloaded on unwanted rotary movements. In addition, a guidance configured as a ring guide makes possible a moving out of the rollers without the direction of rotation of the rotor having to be changed. It is rather the case that with such a ring guide, regions in which the hose rollers are moved out alternate with regions in which the hose rollers are moved in. Such an alternating moving out and in of the hose rollers can be made possible by a simple further rotation of the adjustment element with respect to the rotor.

Further advantageously, the guidance in accordance with the invention comprises two or more identical segments; with a ring guide in particular two or more sequential, identical segments. Due to the symmetrical design, the bearing shaft of the cam disk is not loaded with transverse forces during the moving in and out of the rollers, the friction is thus minimized and the design for low forces is made possible. With a ring guide, the two or more identical segments are connected to one another. The number of identical segments preferably corresponds to the number of hose rollers.

Further advantageously, the guide has spirally, i.e., curved inwardly extending regions which are associated with the respective counter-elements for the movement of the hose rollers. These curved inwardly extending regions thus pull the counter-elements inwardly on a relative movement of the adjustment element and the rotor and provide for a pulling in of the hose rollers. The gradient of the curved inwardly extending regions is advantageously configured such that the torque required for the movement of the hose rollers in the radial direction is substantially constant over the spiral region. It is thus in particular possible to associate a continuously decreasing gradient with the continuously increasing spring force on the pulling in of the rollers so that an unchanging torque is achieved over the total pulling-in path of the hose rollers. The existing torque capacity of the rotor drive can thus be utilized in an optimum manner for the pulling in of the rollers and the rotor drive does not need a higher torque configuration than a conventional rotor drive.

Further advantageously, the curved inwardly extending regions are regions with a gradient which is oppositely directed and advantageously more pronounced. The hose rollers can thus be moved out again by a further rotation of the rotor, with the moving out here anyway taking place in the direction of the bias of the hose rollers via the springs. An abutment of the counter-elements at ends of the guidance is also prevented.

Further advantageously, the guidance has regions without gradient or with a latch depression in which the counter-elements rest when the hose rollers are pulled in. In both cases, the reaction between the guidance and the counter-elements is cancelled and the springs for the bias of the hose rollers remain tensioned without moving the adjustment element. It is therefore possible in the position of the moved in rollers to bring the brake device out of engagement again and to switch off the rotor drive with pulled-in rollers. The pump hose can thus be removed or inserted without risk and comfortably in the position "rollers moved in", with the rotor still remaining rotatable in this position. In addition, the rotor can be removed and reinserted without risk in this position, for instance for cleaning or replacement purposes.

Further advantageously, the guidance in accordance with the invention has regions in which a radial movement of the moved out hose rollers is possible without the adjustment element being moved with respect to the rotor. These regions advantageously correspond to a position with moved-out hose rollers. In this position, the hose rollers can carry out their typical pendulum movement inwardly and outwardly in pump operation without them restricting the guidance in this process. Further advantageously, the adjustment element can also be adjusted by a certain angular range around this position with moved out hose rollers without the guidance moving the hose rollers. A certain play thus results around the position of the adjustment element adopted in normal pump operation.

Further advantageously, the brake actuator in accordance with the invention is arranged at the stator. A constructionally simply designed adjustment element thus results which only requires a little additional constructional space, e.g. at the rotor. The brake device is also substantially simpler to control since all moving parts can be arranged at the stator and the adjustment elements does not have to have any moving parts.

Further advantageously the brake device in accordance with the invention has a brake pin which cooperates with a corresponding cut-out. A particularly simple brake device hereby results by shape matching, with e.g. only the brake pin having to be introduced into the corresponding cut-out and thus being able to fix the adjustment element at the stator.

Further advantageously, the brake pin is arranged at the stator and the cut-out is arranged at the adjustment element. This produces a particularly simple construction.

Further advantageously, the brake device alternatively has a movable brake shoe which cooperates with a rigid brake counter-element. A simple brake device thus also results which is based on force transmission.

Advantageously, the brake shoe is arranged at the stator and the brake counter-element is arranged at the adjustment element. The adjustment element can thus manage without movable parts and the movement of the brake shoe can take place via the brake actuator from the stator.

Further advantageously, in accordance with the invention, hose guide wings are arranged at the rotor and their radial spacing from the hose roller track of the stator is larger than twice, advantageously larger than three times, the wall thickness of the hose used. This e.g. corresponds to a spacing of more than 4 mm, advantageously of more than 6 mm. The problems occurring in the prior art of the clamping and squeezing of the hose can hereby be effectively prevented, with the short hose guide wings in accordance with the invention being made possible in that the hose rollers for the insertion of the hose into the rotor can be pulled in and thus only a small force effort is required for the introduction of the hose through the hose guide wings.

Further advantageously, the hose guide wings have guide rollers whose rounding radius toward the outer end face is larger than 20%, further advantageously larger than 40%, of the outer diameter of the pump hose. This large radius is also only made possible by the adjustability of the hose rollers and thus prevents the clamping of the hose which occurs in the prior art.

BRIEF DESCRIPTION OF THE DRAWINGS

The present invention will now be explained in more detail with reference to an embodiment and to the drawings. There are shown.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
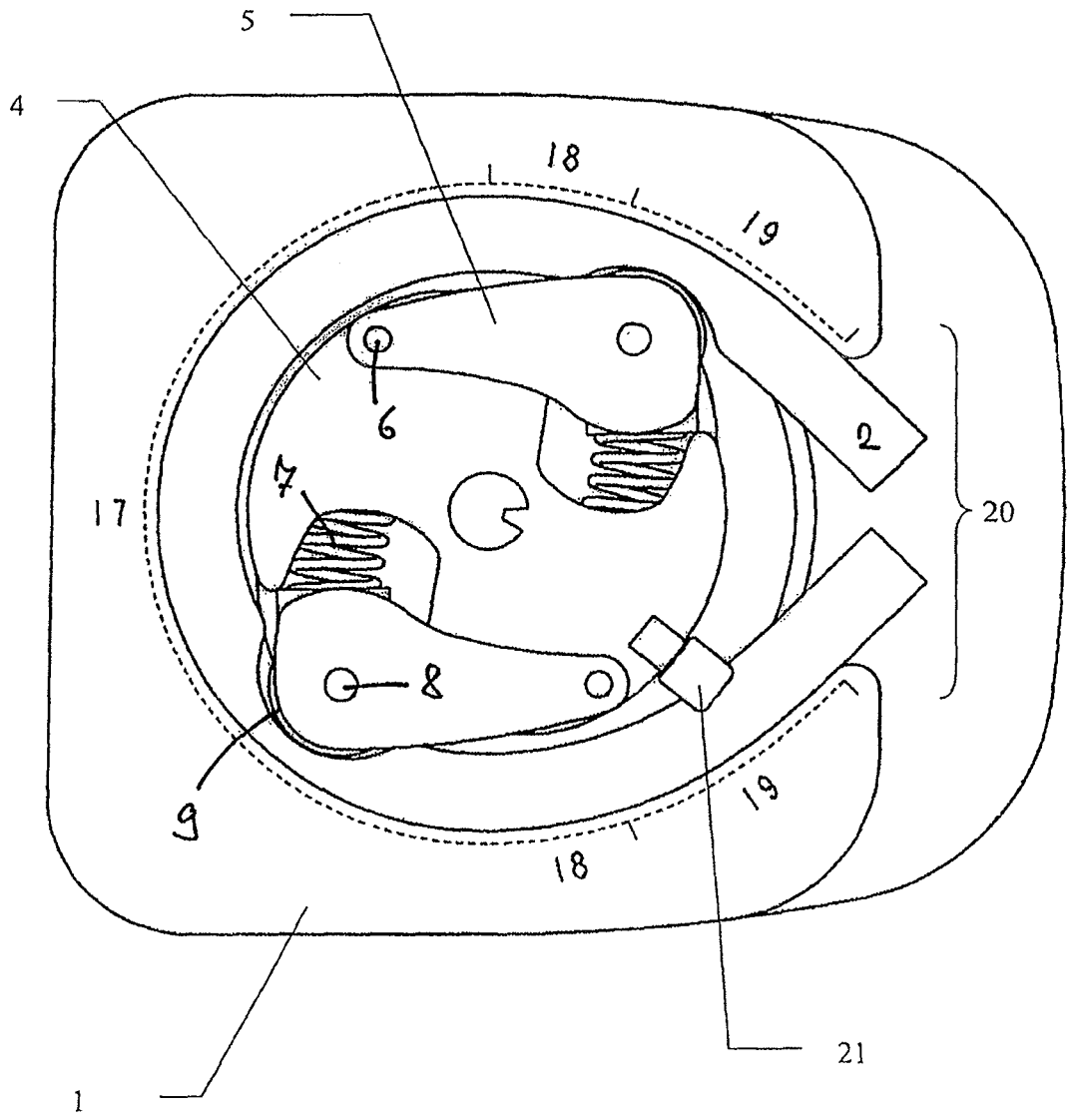
FIG. 1: a plan view of an embodiment of a hose roller pump in accordance with the present invention.
Figure 2:
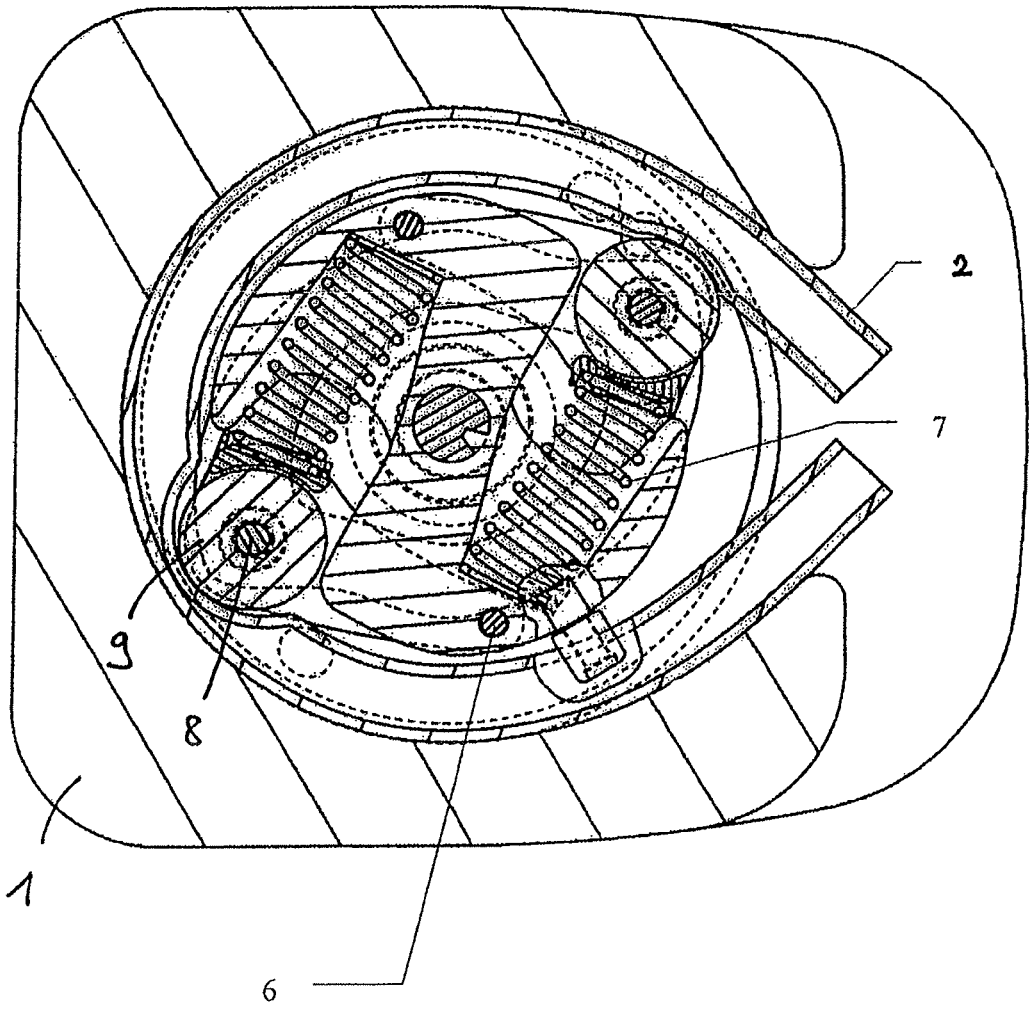
FIG. 2: a section through the hose plane of the embodiment.
Figure 3:
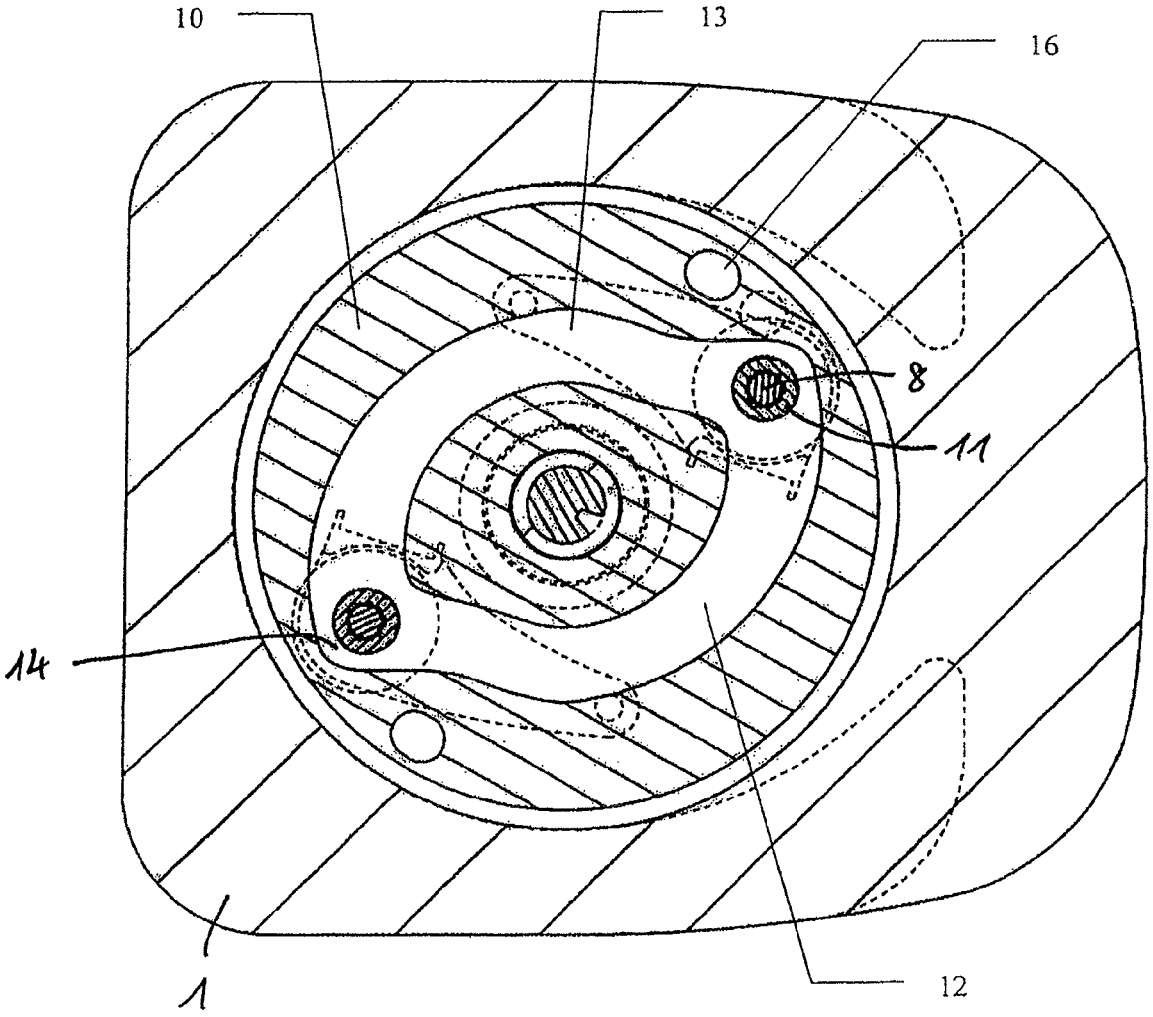
FIG. 3: a section through the cam disk plane of the embodiment.
Figure 4:
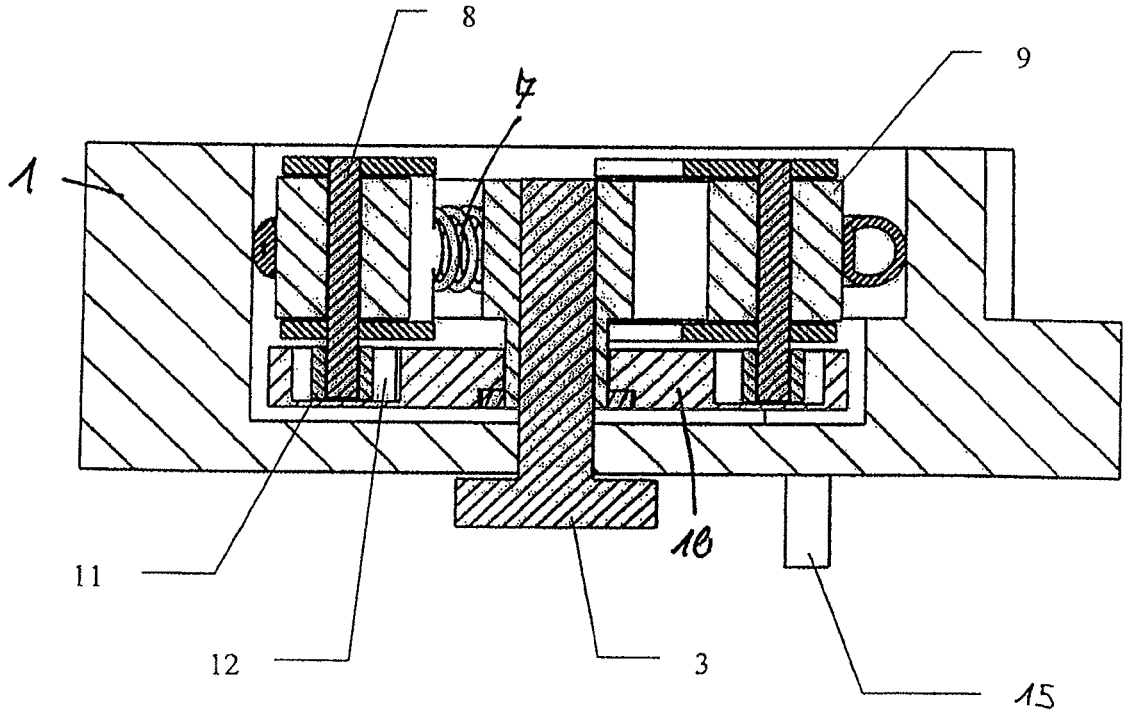
FIG. 4: a section through the rotor axis plane of the embodiment.
Figure 5:
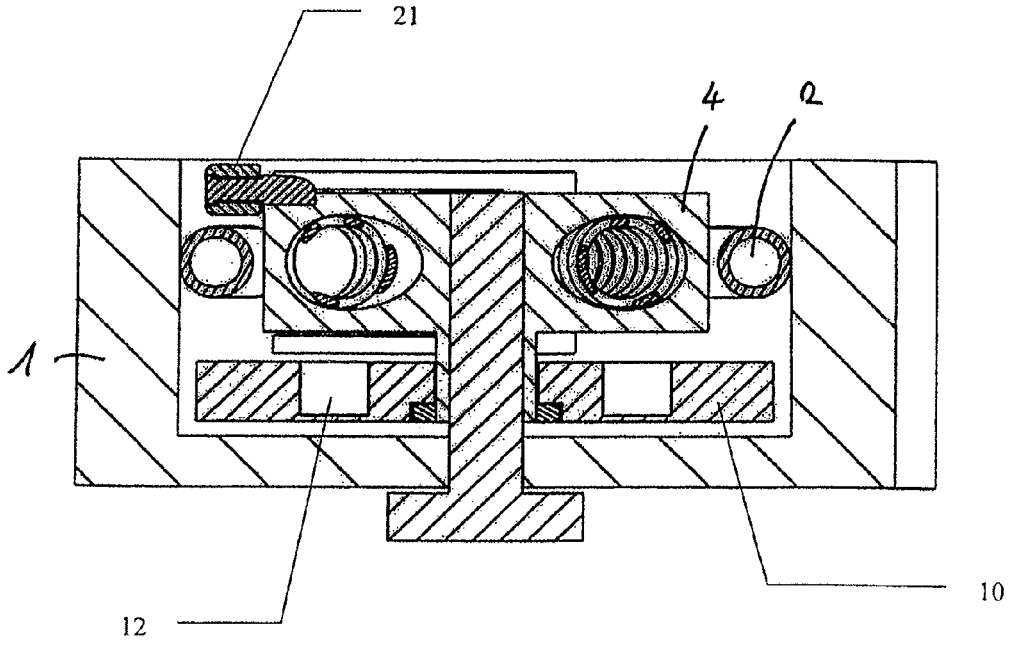
FIG. 5: a section through the rotor axis plane in the region of the hose guide wings of the embodiment.
Figure 6:
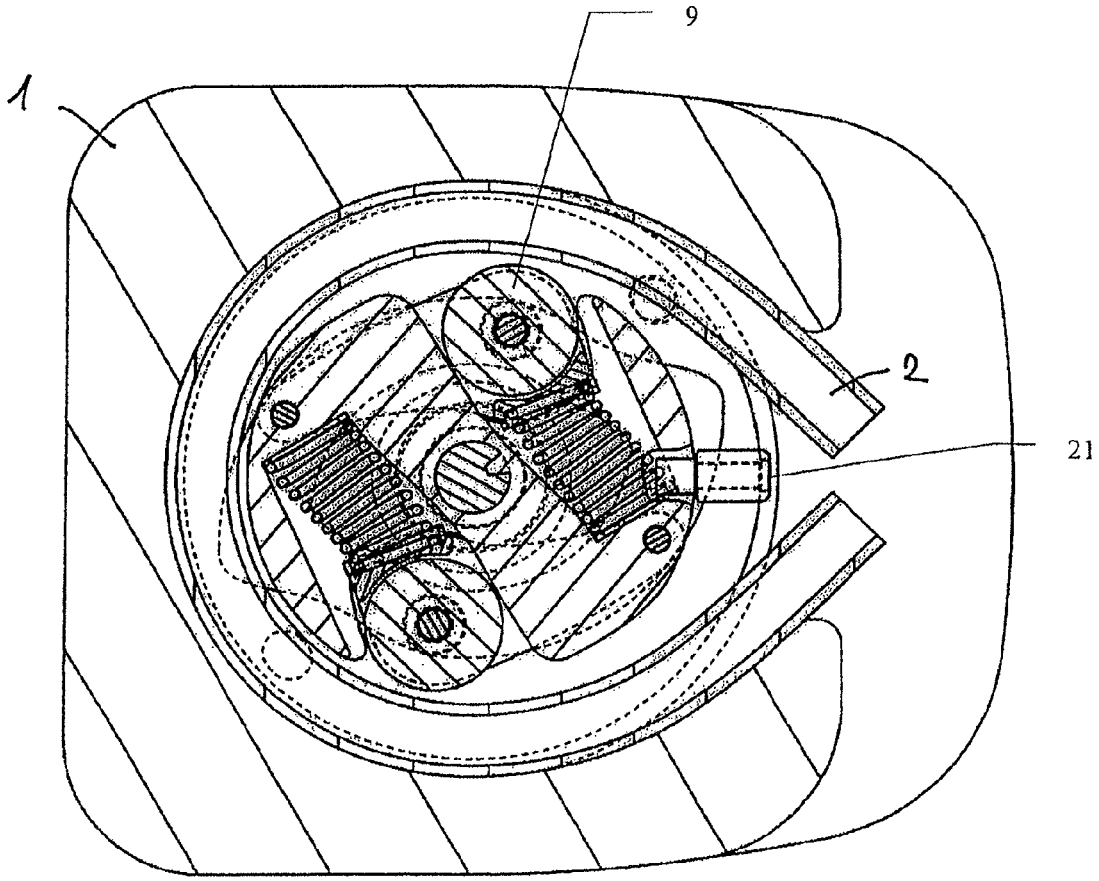
FIG. 6: a section through the hose plane of the embodiment with pulled-in hose rollers.

The general design of the embodiment of the present invention is based on the proven base type already described above so that reference is made to the description of the prior art with respect to the basic design and the pump function of the present invention. With respect to the elements visible in FIG. 1, the present invention also only differs from the prior art by the shorter and more rounded hose guide wings 21. It is however, otherwise identical to a hose roller pump in accordance with the prior art in the base elements of the rotor and of the stator. The embodiment of the present invention therefore also has the same advantageous properties in pump operation of the long proven hose roller pumps, with now, however, a substantially simplified insertion and removal of the hose being possible by the adjustment possibility shown in the following drawings.

The rotor of the embodiment of the hose roller pump in accordance with the invention is based on the conventional rotor and is only supplemented by the addition of an adjustment element made as a cam disk 10, two similar cam rollers 11 as counter-elements for the guide made as a cam groove 12 and an axial support securing plate for the coaxial support of the cam disk 10 at the rotor to form a roller pulling-in rotor with an adjustment device for the hose rollers. A mechanism thus results which is largely the same as conventional hose pumps with respect to construction space and with only minimally increased costs with respect to known hose pumps. In addition, a brake device 15 only has to be arranged at the stator 1, with an easily and effectively sealable brake device being selected via a brake pin.

The embodiment of the present invention will now be explained in more detail with respect to FIGS. 1 to 9. FIGS. 1 to 9 show simplified representations of the mechanism in the positions "rollers moved out" or "rollers moved in" and in different positions of angular rotation of the rotor.

The rotor assembly includes the hub shell 4, the wings 5, the wing joints 6, the springs 7, the roller axles 8, the hose rollers 9, the cam disk 10, the cam rollers 11, the rotating shaft 3 of the rotor drive 50, and the engagement positions 16 of the brake device 15 on the rotor side for the blocking of the cam disk 10.

The stator assembly includes the pump bed 1 with the pump bed mouth 20, the hose roller track 17 . . . 19, the support of the rotor shaft and the actuator system of the brake device 15.

The rotor assembly differs from conventional rotors by the cam disk 10 additionally rotatably supported independently of the hub shell 4 and by the extended roller axles 8 at whose end cam rollers 11 are affixed which are rotatable independently of the hose rollers 9 and which engage into the cam grooves 12 of the cam disk. The cam rollers 11 can alternatively also be supported on separate axles fixed to the wings 5.

Figure 7:
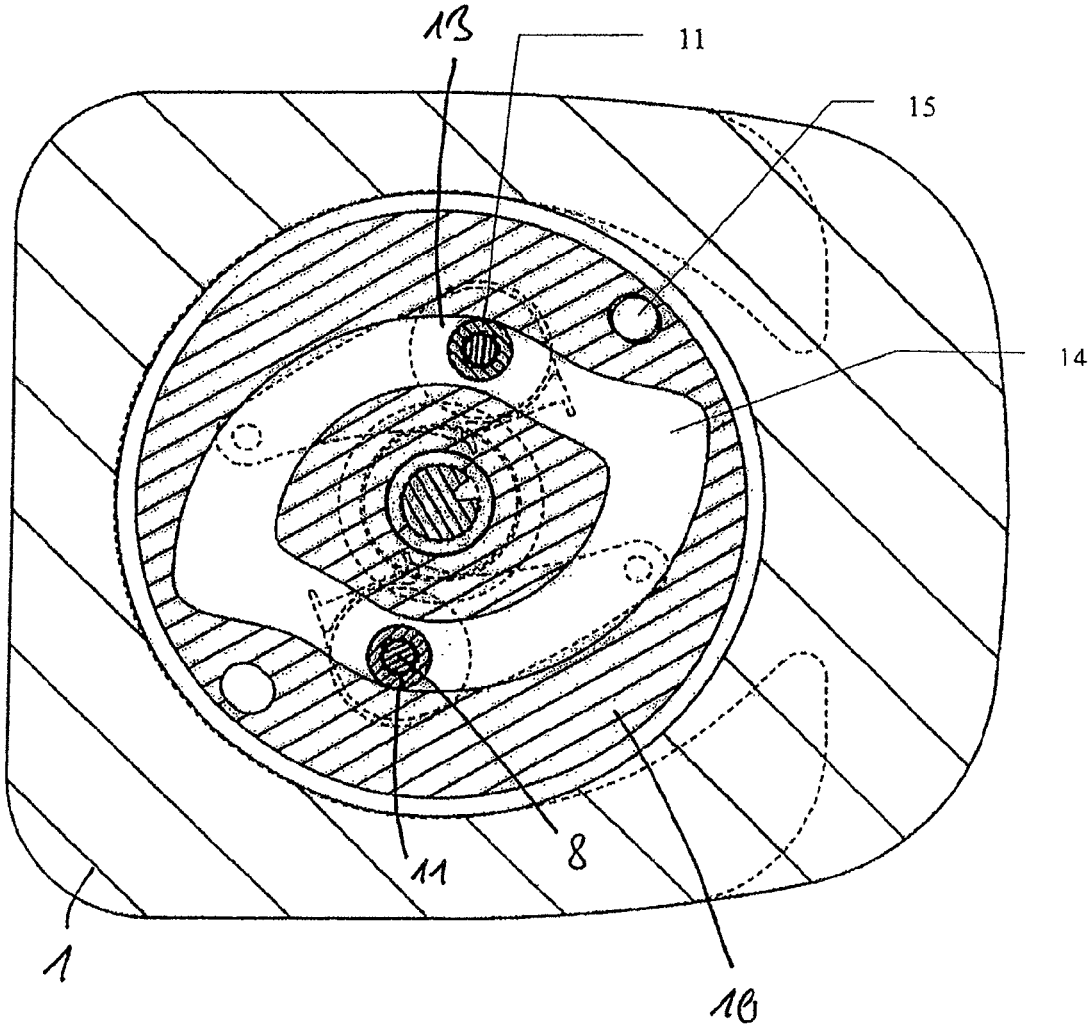
FIG. 7: a section through the cam disk plane of the embodiment with pulled-in hose rollers.
Figure 8:
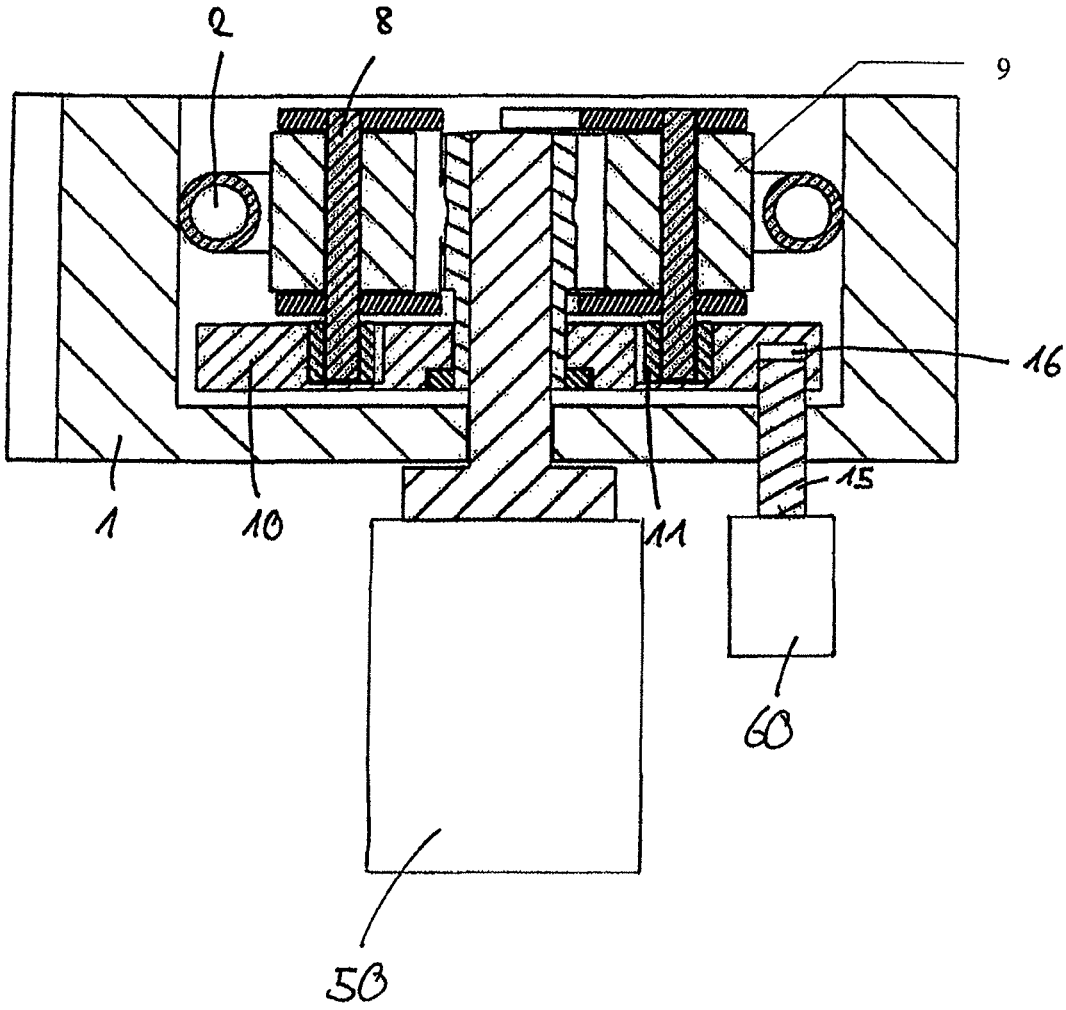
FIG. 8: a section through the rotor axis plane of the embodiment; in the region of the brake device in accordance with the invention.
Figure 9:
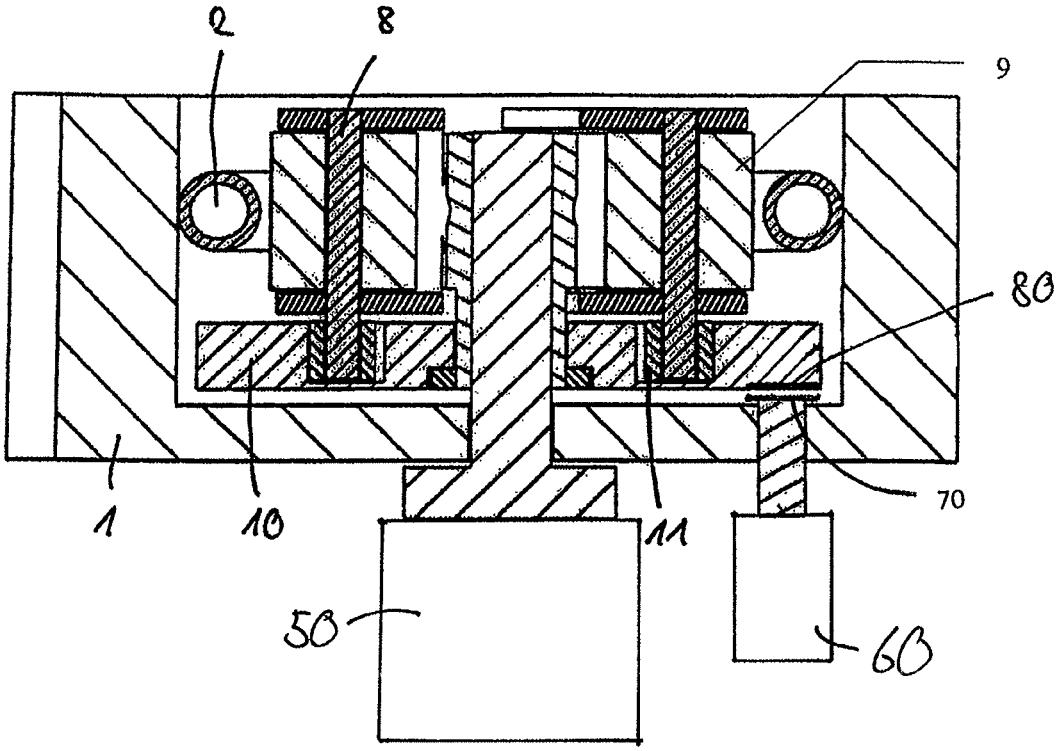
FIG. 9: a second view of a section through the rotor axis plane of the aforementioned embodiment, in the region of the brake device in accordance with the invention.

The brake mechanism 15 is activated for the moving in of the hose rollers 9 in that the brake actuator 60 on the stator side establishes a friction-fitting or shape-matched connection between the fixed stator and the rotatably supported cam disk (see FIGS. 7, 8, and 9). With an applied brake, the rotor drive 50 now rotates the hub shell 4 through approximately 120 angular degrees (depending on the configuration of the cam groove) until the cam rollers 11 have moved into the position 13 "rollers moved in" (see FIGS. 3+7). The wings 5 at which the hose rollers 9 are supported, and thus also the hose rollers 9 and the cam rollers 11 are always pressed radially outwardly by the springs 7. The cam rollers 11 therefore only move on the radially outwardly facing running tracks of the cam grooves 12. The cam grooves 12 extend spirally inwardly in the angular range of the roller entry and transform the rotary movement of the rotor into a moving-in movement of the hose rollers 9.

It is possible due to the gradient ratios of the cam grooves 12, which can be selected within wide limits, to associate a continuously decreasing gradient of the cam groove 12 with the continuously increasing spring force on the pulling in of the hose rollers 9 so that a constant torque is achieved. The existing torque capacity of the rotor drive 50 is thus utilized in an optimized manner for the pulling in of the rollers 9. The rotor drive 50 does not need any higher torque configuration than a conventional rotor drive.

With completely pulled-in rollers 9, the cam rollers 11 hold the cam groove in the position 13 "rollers moved in." In this rotary angle position, the cam groove can have a zone with zero gradient or a small latch depression. In both cases, the reaction between the cam disk 10 and the wing movement is cancelled and the springs 7 remain tensioned without being able to set the cam disk into a rotary movement. It is therefore possible in the position "rollers moved in" to again bring the brake 15 out of engagement and thus to switch off the rotor drive a 50 with moved-in rollers 9. The brake actuator 60 is sensibly configured bistably powerless (pulse circuit) or as out of engagement when powerless (spring restoration). In this manner, energy is only consumed for the change in position of the brake (pulse circuit) or only during the moving in or out of the rollers (spring restoration).

The rotor reaches a location at the position 13 "rollers moved in" in which the pump hoses can be removed without risk and comfortably and in which the rotor can be removed and put back in again without risk (for instance, for purposes of cleaning or replacement).

The ring gap which arises due to the pulling in of the hose rollers 9 is larger than the outer diameter of the pump hose due to the suitable configuration of the wing kinematics of the springs 7 and of the cam disk 10. A low-force hose exchange is thus also ensured with an imprecise coaxial installation and removal movement. On removal, the pump hose generally has a rounder shape due to the pump operation so that the removal is particularly simple after the moving in of the hose rollers 9.

On the selection of the brake device (15), a variety of constructional shapes are feasible in dependence on the existing place relationships and the brake actuators 60 to be used. The brake actuators 60 can, for example, selectively act axially (as shown in certain of the Figures) or radially (as with a shoe brake, i.e., a brake shoe 70 which cooperates with a brake counter-element 80 as shown in FIG. 9) on the cam disk. Furthermore, the brake action can be effected by a pure shape matching (as shown), by friction fit (as with a shoe brake) or by combined shape matching and friction fit (as with a shaft-toothed torque limitation). The pin brake shown with pure shape matching has the advantages of a very cost-effective realization with high permissible tolerances, of a minimal energy requirement, and an effective and hygienic sealing of the passage position of the brake pin through the stator base. With friction fitting or sufficiently fine radially active brake constructions with slip toothing, it can, in contrast, be achieved that the rotor can be brought into any desired rotary position for the moving in and out of the rollers and to be secured against torque overload in the event of control errors in this process. In all the brake constructions described, it is again possible to choose between an asymmetric and a symmetrical constructional shape. With the asymmetric constructional shape, only one brake actuator acts on the cam disk. The counter-force must therefore be absorbed by the cam disk bearing and the motor shaft as a transverse force. If one would also like to avoid this transverse force and the torque thereby increased on the pulling in of the rollers, then the symmetrical brake constructional shape with pair-wise brake actuators arranged with point symmetry to the rotor axis is selected.

The brake is applied in turn for the moving out of the hose rollers 9 and the rotor is rotated in the opposite rotary direction. In this connection, the mechanism only requires one impulse of some angular degrees from the side of the rotary drive. The remaining angular movement up to the reaching of the position 14 "rollers moved out" can as a rule take place with the rotor drive switched off or even braked since the relaxed springs 7 drive the rotor rotational movement and the roller moving-out movement. On the use of the preferred construction of the pair-wise connected cam grooves, the moving out of the rollers also functions by the further rotation of the rotor in the same direction as on the moving in of the hose rollers 9 (see FIG. 7).

In the position 14 "rollers moved out", the cam groove 12 is radially outwardly and inwardly widened. In this manner, the wings 5 can carry out their typical pendulum movement inwardly and outwardly (at the fixed abutment) in pump operation without the cam rollers 11 abutting the cam groove 12 radially outwardly or inwardly. The cam disk 10 is now no longer driven by the spring forces from the cam rollers 11 in the position "rollers moved in" and is also no longer put into operation. The cam disk 10 in this position has an angular clearance of some degrees in both directions before the cam roller 11 can again take up contact with the cam roller running track.

The cam disk remains in the found rotary position due to the friction of the simple ball bearing-less rotary support between the cam disk 10 and the hub shell 4. The brake device 15 is brought out of engagement and the pump operation can start (see FIG. 4). In this position, the energy supply can alternatively be switched off at the rotor drive and at the brake actuator without an unwanted movement resulting therefrom. The rotor can thus also be installed and removed without danger in the position "rollers moved out".

In pump operation, the rotor equipped with a cam disk behaves as a conventional hose pump motor. The cam disk 10 is out of engagement with the brakes 15 and out of engagement with the cam rollers 11 and rotates along with the rotor.

So that no unwanted rotations can occur between the cam disk 10 and the hub shell 4, for instance due to vibrations of the stator or rotor, which could result in a knocking of the cam roller 11 at the flanks of the cam roller running track, the cam disk is configured to be strictly symmetrical so that it cannot experience any different frictional force transfers at its rotary bearing position depending on the position. The bearing friction deliberately generated by the construction between the cam disk 10 and the rotor shaft bearing provides a knock-free pump operation. Where required, it is constructionally easily possible also to insert a latching between the cam disk 10 and the hub shell 4 for the position "rollers moved out", for instance by a sprung latch nose which facilitates a latch position between the cam disk and the hub shell at a position selected independently of the cam groove 12 or by a friction increase due to a wavy cam disk/axial bearing disk made resiliently.

The following differences and advantages result with respect to hose roller pumps from the prior art:

A mechanism results which is largely of the same construction space with respect to the conventional hose pumps having only one additionally required brake pin passage through the pump bed base which can be sealed easily and effectively.

The rotor transforms itself from the conventional rotor to the roller pulling-in rotor by adding only three components: a cam disk 10, two similar cam rollers 11, and an axial bearing securing disk for the cam disk. Additional costs hereby only result for the adjustment mechanism, i.e., to the amount of a few euros.

A complete geometrical setting free of the pump hose segment after pulling in the hose rollers 9 becomes possible and hereby a simple laying in and removal of a simple pump hose, of a pre-fixed pump hose (clip) or of a cassette equipped with a pump hose.

Due to the selected principle, the hose roller pump in accordance with the invention is also suitable for use with cassettes which are equipped with more than one pump hose.

A rotor drive of unchanged technical construction and performance can be used as the drive of the roller pulling-in mechanism. The invention is thereby cost-saving and reliable in a proven manner.

The hose roller pump in accordance with the invention has no different function to conventional hose roller pumps in pump operation, whereby a high, proven reliability and an especially low development risk is ensured.

An automatically running process for the coupling and uncoupling of the hose rollers to the pump segment is possible, whereby the possibility for the pump bed covering while avoiding the risks of injury for the operator results.

The pump hoses are largely straight after their extrusion and are brought by elastic bending into the shape which permits them to be laid into the pump bed and to contact the largely round hose roller track at the outer side. Irrespective of whether the pump hose is only bent on the installation or whether it is already bent in the course of the manufacture of a pre-fixed pump hose loop or on the attachment to cassettes, no round shape arises on the bending, but an approximately oval one. When the pump hose length is configured such that the hose either does not drag at the hub shell 4 or is not so long that it no longer fits into the pump bed, an oval shape arises such that the largest diameter is somewhat larger than the diameter of the hose roller track. The pump hose can thus be placed in one operation, and without the assistance of a second hand, into a peripheral ring gap as realized by the roller entry on the side of the pump bed mouth without resistance up to and into the required position in the pump bed, above all when it is held by a clip or by a cassette. On the side of the hose roller track disposed opposite the pump bed mouth, however, the hose then abuts the introductory chamfer of the hose roller track due to the previously described larger oval diameter and does not always move into the depth position required for pumping due to friction. As a result, the complete installation has to take place by subsequent jogging by hand or by the initially described procedure of the automatic threading in using the roller-equipped hose guiding wing 21. An important advantage of the moved-in rollers now lies in the fact that this threading-in procedure takes place successfully with very low forces so that the hose guide wing 21 can be made so short in comparison with the otherwise required hose guide wings that the residual gap between its end face and the hose roller running track is larger than twice the wall thickness of the pump hose. The rounding radius of the end face can equally be selected much larger than the conventional one. A hose straining by clamping the pump hose and a transverse force overload of the rotor shaft can thus be avoided.

The automatic threading procedure just described which runs with shortened and very rounded hose guide wings requires the capability of the described mechanism to be able to rotated with pulled-in rollers, which is achieved by the corresponding positions 13 "rollers moved in" of the cam groove 12 with zero gradient or with a latch depression.

A special feature is represented by the fact that the hose rollers 9 can be moved in and out without removing the pump segment and with low control effort. New treatment methods thus above all become possible in medical treatment units in which the switchable passage position can deliberately be utilized for new technical process procedures.

With the mechanism in accordance with the invention, the hose rollers 9 can be pulled in so far inwardly that the pump hose is set completely free geometrically and can be removed with low resistance. The installation takes place by simple latching insertion of the pump hose segment with subsequent automatic threading into the complete installation position.

In the mechanism in accordance with the invention, the cam disk has two symmetrical cam groove regions whose starts and ends are each connected by a short piece of a groove with greater gradient in a preferred embodiment. Due to the symmetrical design, the bearing shaft of the cam disk 10 is not loaded with transverse forces during the moving in and out of the hose rollers 9, the friction is thus minimized and the design for low forces is made possible. Due to the connection of the two groove segments to form a peripheral ring groove 12, an effective overload protection is created in the case of defects in the control processes of the rotational angle of the rotor with an applied brake. A crash due to abutment of the cam roller 11 at the ends of a cam groove cannot take place. The gradient of the two connection grooves is selected to be just large enough such that the rotor mechanism can also not be overloaded on unwanted rotary movements.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A hose roller pump comprising:

a stator, a rotor, and a rotor drive, the rotor including hose rollers whose position is variable in a radial direction via an adjustment device having a movable adjustment element; and a brake device arranged at the stator, the brake device being configured for connection with the adjustment device so that the radial position of the hose rollers is variable by the adjustment element through interplay of the brake device and the rotor drive, with the rotor drive and the brake device configured to provide relative movement between the rotor and the adjustment element by rotating the rotor via the rotor drive and at a same time braking the movement of the adjustment element via the brake device.

2. The hose roller pump in accordance with claim 1, wherein the connection between the brake device and the adjustment device is a lockable connection configured such that the hose rollers are movable radially inwards by rotation of the rotor.

3. The hose roller pump in accordance with claim 1, wherein the brake device is actuated by a brake actuator that is controlled by control of the pump.

4. The hose roller pump in accordance with claim 1, wherein the brake device inhibits the movement of the adjustment element such that the rotor is moved with respect to the adjustment element by braking the adjustment element and by rotating the rotor to vary the position of the hose rollers.

5. The hose roller pump in accordance with claim 1, wherein the adjustment element is rotatably supported coaxially to the rotor.

6. The hose roller pump in accordance with claim 1, wherein the adjustment element is rotatably supported at the rotor.

7. The hose roller pump in accordance with claim 1, wherein the adjustment element rotates along with the rotor in normal operation.

8. The hose roller pump in accordance with claim 1, wherein the adjustment element is at least one of configured symmetrically with the rotor, and latchable with the rotor.

9. The hose roller pump in accordance with claim 1, wherein the brake device inhibits relative movement between the stator and the adjustment element.

10. The hose roller pump in accordance with claim 1, wherein the rotor includes movable bearing elements at which the hose rollers are rotatably supported.

11. The hose roller pump in accordance with claim 1, wherein at least one of the adjustment element and the rotor have a guide which cooperates with one or more counter-elements for the radial movement of the hose rollers.

12. The hose roller pump in accordance with claim 11, wherein at least one of the counter-elements and the guide are fixedly connected to bearing elements for the hose rollers.

13. The hose roller pump in accordance with claim 11, wherein the guide is configured as a cam groove.

14. The hose roller pump in accordance with claim 11, wherein the guide is configured as a peripheral ring guide.

15. The hose roller pump in accordance with claim 11, wherein the guide includes two or more identical segments.

16. The hose roller pump in accordance with claim 11, wherein the guide has curved inwardly extending regions which are associated with the respective counter-elements for the movement of the hose rollers, a gradient of the curved inwardly extending regions being configured such that a torque required for the movement of the hose rollers in the radial direction is substantially constant over the curved region.

17. The hose roller pump in accordance with claim 16, wherein the curved inwardly extending regions are connected by other regions having a gradient running in an opposite direction that is greater than a gradient of the curved inwardly extending regions.

18. The hose roller pump in accordance with claim 11, wherein the guide has regions without gradient or with a latch depression in which the counter-elements rest with pulled in hose rollers.

19. The hose roller pump in accordance with claim 11, wherein the guide has regions in which a radial movement of the moved out hose rollers is possible without the adjustment element being moved with respect to the rotor.

20. The hose roller pump in accordance with claim 1, wherein the brake actuator is arranged at the stator.

21. The hose roller pump in accordance with claim 1, wherein the brake device has a brake pin which cooperates with a corresponding cut-out.

22. The hose roller pump in accordance with claim 21, wherein the brake pin is arranged at the stator and the cut-out is arranged at the adjustment element.

23. The hose roller pump in accordance with claim 1, wherein the brake device has a movable brake shoe which cooperates with a rigid brake counter-element.

24. The hose roller pump in accordance with claim 23, wherein the brake shoe is arranged at the stator and the brake counter-element is arranged at the adjustment element.

25. The hose roller pump in accordance with claim 1, further comprising hose guide wings arranged at the rotor, with a radial spacing of the hose guide wings relative to a hose roller track of the stator being larger than two times a wall thickness of a hose of the roller pump.

26. The hose roller pump in accordance with claim 25, wherein the hose guide wings have hose guide rollers with a rounding radius toward an outer end face thereof that is larger than 20% of an outer diameter of the pump hose.

27. The hose roller pump according to claim 8, wherein the adjustment element is in a position in which the hose rollers are moved outward.

28. The hose roller pump according to claim 15, wherein the two or more identical segments are two or more sequential identical segments.

29. The hose roller pump according to claim 25, wherein the radial spacing of the hose guide wings relative to the hose roller track of the stator is larger than three times the wall thickness of the hose.

30. The hose roller pump according to claim 26, wherein the hose guide wings have hose guide rollers with a rounding radius toward the outer end face thereof that is larger than 40% of the outer diameter of the pump hose.

31. A hose roller pump comprising:

a stator, a rotor that includes hose rollers, and a rotor drive, with a position of the hose rollers being variable in a radial direction relative to the rotor via an adjustment device that includes an adjustment element; and a brake device provided at the stator, the brake device being configured for connection with the adjustment device such that the radial position of the hose rollers is varied by the adjustment element, with the rotor drive and the brake device configured to provide relative movement between the rotor and the adjustment element by rotating the rotor via the rotor drive and at a same time inhibiting the movement of the adjustment element via the brake device.

32. The hose roller pump according to claim 31, wherein the connection between the brake device and the adjustment device is a lockable connection configured such that the hose rollers are movable radially inward by rotation of the rotor.

* * * * *

UNITED STATES PATENT AND TRADEMARK OFFICE

CERTIFICATE OF CORRECTION

PATENT NO. : 8,568,115 B2
APPLICATION NO. : 12/451244
DATED : October 29, 2013
INVENTOR(S) : Martin Lauer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 404 days.

Signed and Sealed this
Fifteenth Day of September, 2015

Michelle K. Lee

Michelle K. Lee
*Director of the United States Patent and Trademark Office*